United States Patent [19]

Weiner

[11] Patent Number: 4,554,994

[45] Date of Patent: Nov. 26, 1985

[54] LADDER SAFETY INDICATOR

[76] Inventor: Robert I. Weiner, 305 Chesapeake Ave., Towson, Md. 21204

[21] Appl. No.: 698,456

[22] Filed: Feb. 5, 1985

[51] Int. Cl.[4] ..... E06C 7/00; E06C 5/34; E06C 5/36

[52] U.S. Cl. ..... 182/18; 182/111; 182/129

[58] Field of Search ..... 182/18, 129, 107, 108, 182/111; 33/1 N, 391

[56] References Cited

U.S. PATENT DOCUMENTS 2,845,719 8/1958 Thomiszer ..... 182/18
3,118,234 1/1964 Wilson ..... 182/18

FOREIGN PATENT DOCUMENTS 1178104 9/1964 Fed. Rep. of Germany ..... 182/18

OTHER PUBLICATIONS

American Natl. Standard, A14.5-1981, pp. 61-79.

*Primary Examiner*—Reinaldo P. Machado
*Attorney, Agent, or Firm*—Peter L. Klempay

[57] ABSTRACT

In order to indicate whether a straight or extension ladder is positioned safely for use, a first label is provided on the side rail of the ladder and includes a level for indicating when the ladder is properly angled and a second label and a cooperating pointer are provided at the foot of the ladder to indicate if the base of the ladder is at a safe angle relative to the support surface.

3 Claims, 4 Drawing Figures

LADDER SAFETY INDICATOR

The present invention pertains to safety indicators for use with ladders such as extension ladders and, more particularly, to such indicators for showing whether the ladder is positioned so as to be safely climbed.

BACKGROUND OF THE INVENTION

When a straight or extension ladder is positioned against a structure, it is essential that the ladder be properly angled to prevent slipping of the ladder feet. As a general rule, the base of the ladder should be positioned at a distance which is one-fourth of the working length thereof from the vertical support. If such positioning is not possible, the top and bottom of the ladder should be braces, tied, or otherwise secured for safety. This general rule, however, assumes that the base of the ladder is positioned on a level surface. This assumption is often not true in practice. When a ladder is positioned on a sloping surface, such as a roof, the angle between the ladder and the support surface is decreased from that when the surface is level with a corresponding decrease in the frictional holding ability of the ladder feet and, accordingly, a greater risk of the ladder slipping when in use.

Indicators, such as those shown in U.S. Pat. No. 2,845,719, Thomiszer, and U.S. Pat. No. 3,118,234, Wilson, have been provided for showing the angular orientation of the ladder but such devices do not take into account the possibility that the ladder will be used on a non-level surface. Similarly, the warning labels provided in American National Standard A14.5-1981 do not provide guidance for the safe use of ladders on sloping surfaces.

It is, accordingly, the primary object of the present invention to provide a safety indicator for a single or an extension ladder which is equipped with an articulated foot that provides a clear indication as to whether the ladder is safely positioned or requires blocking, tieing or the like for said use whether on a level or a sloping surface.

A further object of the invention is the provision of such a ladder safety indicator which may be applied to new or existing ladders without requiring modification of the ladder structure.

SUMMARY OF THE INVENTION

The above and other objects of the invention which will become apparent hereinafter are achieved by the provision of a ladder safety indicator including a first indicator element including a label affixable to the side rail of the ladder and having a level indicator oriented so as to show when the ladder is at the proper angle relative to the vertical and a second indicator element including a label affixable to the side rail in close proximity to the foot of the ladder and a pointer secured to the foot and cooperating with the second label to indicate the angle between the foot and the ladder.

For a more complete understanding of the invention and the objects and advantages thereof, reference should be had to the accompanying drawing and the following detailed description wherein a preferred embodiment of the invention is illustrated and described.

DESCRIPTION OF THE PREFERRED EMBODIMENT

Figure 1:
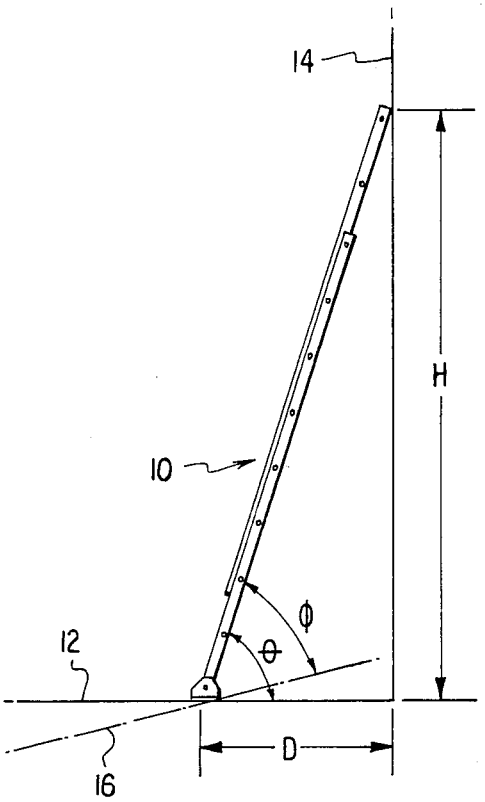
FIG. 1 is an elevational view of a ladder positioned against a structure.

Having reference first to FIG. 1, a ladder 10 is shown positioned on a level or horizontal surface 12 and bearing against a vertical surface 14. In accordance with conventional safety rules, the base of the ladder is located at a distance D from the vertical which is equal to one-fourth the working height H of the ladder, the angle $\theta$ between the ladder and the surface 12 being approximately $75\frac{1}{2}°$. If, however, the support surface is not horizontal but slopes as indicated by the broken line, the angle $\phi$ between the ladder and this surface is less with the consequence that the ladder is more likely to slip as the frictional forces between the ladder and the support surface are also decreased. As was mentioned above, conventional ladder safety indicators and safety rules do not provide an indication of this potentially dangerous condition.

Figure 2:
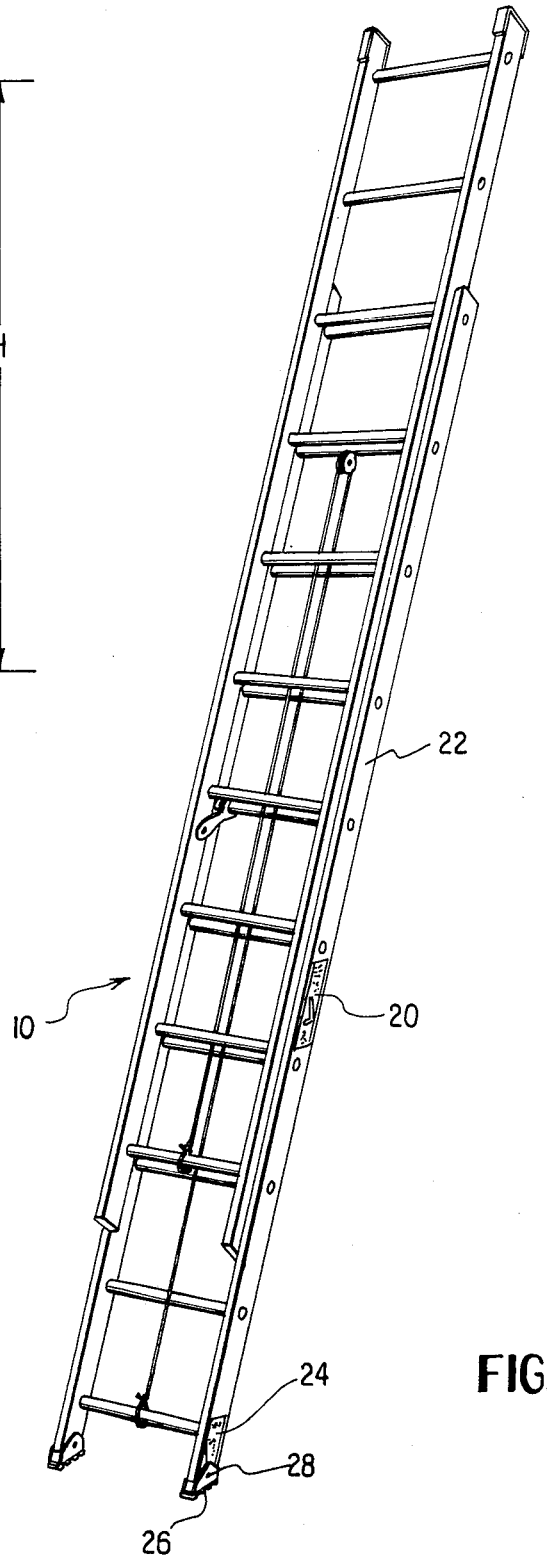
FIG. 2 is a perspective view of an extension ladder equipped with the safety indicator of the present invention.

In accordance with the present invention and as shown in FIG. 2, a first indicator element 20 is provided on the side rail 22 of the ladder at a location convenient for viewing by a person standing beside the ladder. This element serve to indicate whether the ladder is positioned at the proper angle relative to the horizontal and regardless of the angle of the supporting surface. In addition, a second indicator element 24 is provided on the ladder side rail in proximity to the ladder foot 26, the foot being pivotally connected to the side rail by a pin 28 to permit the base of the foot to firmly engage the support surface. This second indicator element serves to show whether the angle between the ladder and the support surface is within the safe range.

Figure 3:
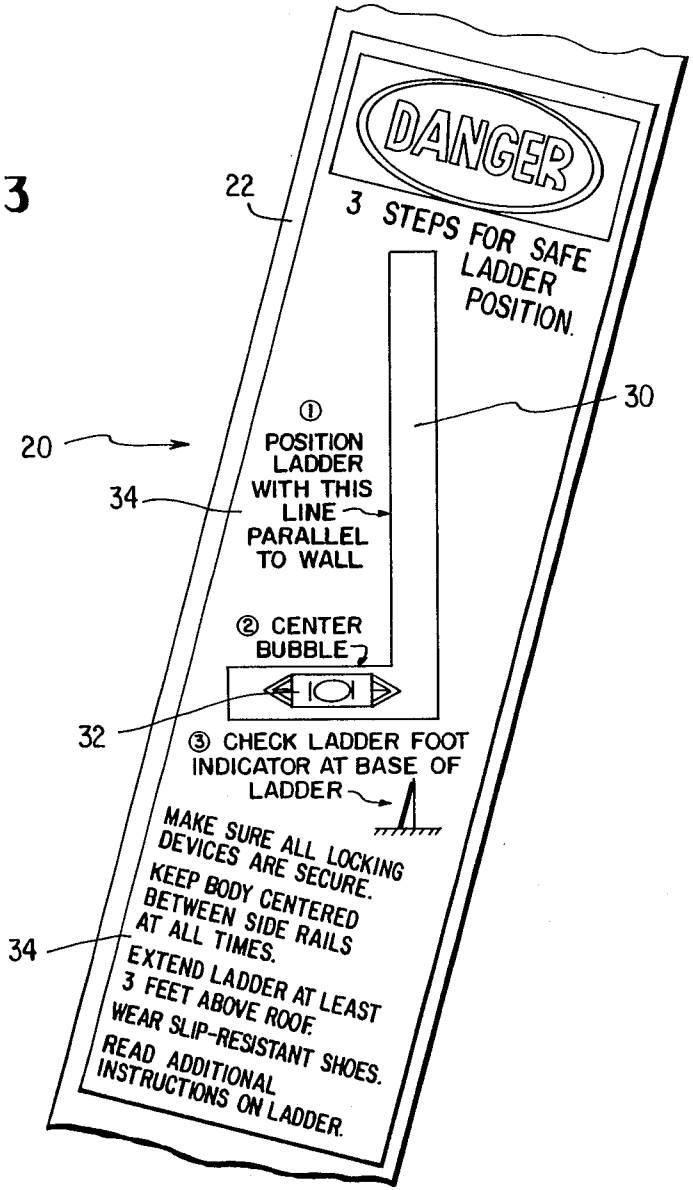
FIG. 3 is an elevational view of the first indicator element of the safety indicator.

The first indicator element 20 is shown in greater detail in FIG. 3 and consists of a label or panel of, preferrably, rectangular configuration adapted to be secured to the ladder side rail 22 in alignment therewith. Typically, the indicator element 20 will have an adhesive backing for this purpose. The element 20 carries an indicating marking 30 in the form of an inverted L oriented so that the longer leg thereof is at the angle $\theta$ relative to the principal length of the side rail, the shorter leg of the marking being at right angles to the longer leg and having a center bubble type liquid level 32 affixed thereto. Appropriate explanatory legends 34 are also provided on the element 20.

Figure 4:
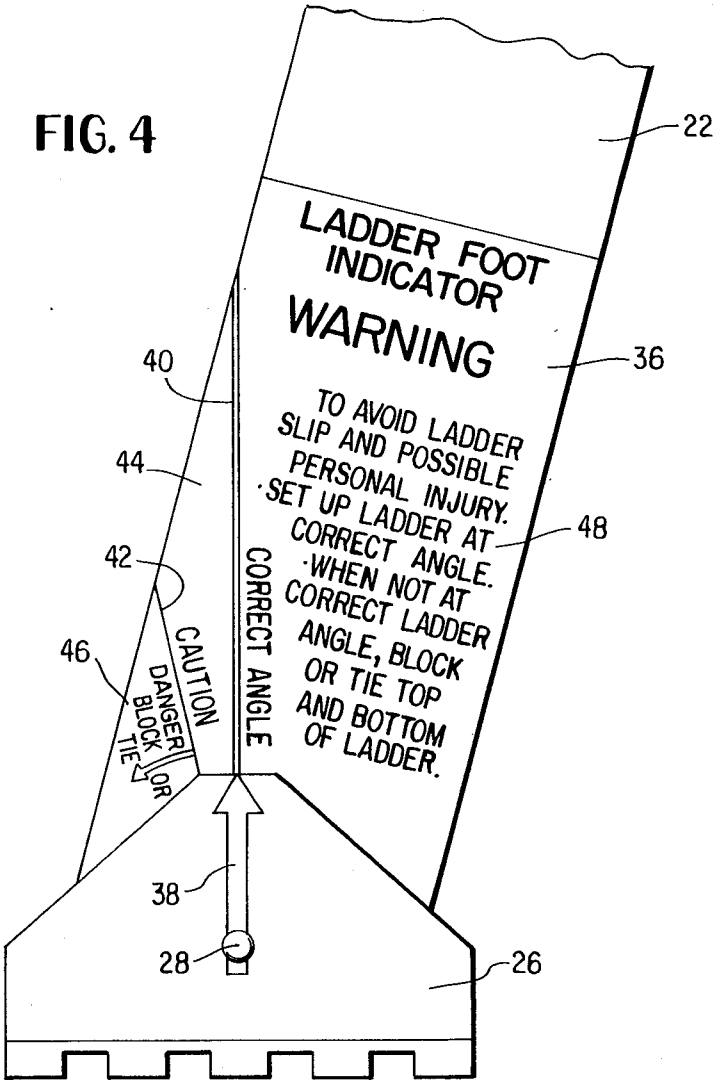
FIG. 4 is an elevational view of the base portion of the ladder with the second indicator element affixed thereto.

The second indicator element 24, shown in FIG. 4, includes a label or panel 36 adapted to be secured to the ladder side rail 22 at the lower end thereof and a pointer 38 adapted to be affixed to or formed on the side face of the ladder foot 26 with the pointer extending upwardly at right angles to the bottom surface of the foot. The label or panel 36 has a first indicator line 40 which extends at the angle $\theta$ relative to the side rail and a second indicator line 42 at a slightly greater angle, these lines radiating from the pivotal axis of the foot connection. The zone 44 between the lines 40 and 42 us, preferrably, marked with the legend "CAUTION" and distinctively colored, being yellow for example, while the zone 46 beyond the line 42 carries a legend such as "DANGER-BLOCK OR TIE" and a distinctive red coloring. Again, appropriate explanatory legends 48 may also be provided.

It will be understood that the opposite side rail of the ladder may be, and preferrably is, provided with the corresponding indicator elements, these elements being mirror images of those shown.

When the ladder 10 is positioned on a horizontal surface with the lower end thereof properly spaced from the vertical support, the level indicator 32 of the first indicator element 20 will be centered and the pointer 38 of the second element 24 will be aligned with the indicator line 40. In this position, the ladder may be safely used without being blocked or tied in place. If the supporting surface is not horizontal, the ladder 10 is first positioned so that the level indicator 32 is centered and the second indicator element is inspected to determine the one of the zones 44 or 46 aligned with the pointed 38. When the pointer indicates the "CAUTION" zone 44, blocking, tieing or otherwise securing the ladder is desirable depending, for example, on the nature of the supporting surface, for example on smooth metal surfaces the ladder must be tied while on rough or sandpaper-like surfaces tieing may not be necessary. An indication in the "DANGER" zone 46 indicates that the ladder must be secured regardless of other factors.

While a preferred embodiment of the invention has been shown and described herein, it will be understood that changes and additions may be made therein and thereto without departing from the spirit of the invention. Reference should, accordingly, be had to the appended claims in determining the true scope of the invention.

I claim:

1. A safety indicator for use with a straight or extension ladder of the type having a pair of side rails and a foot pivotally connected to each side rail at the lower end thereof and having a bottom surface for engaging the ladder supporting surface comprising:

a first indicator element adapted to be affixed to the side rail of the ladder intermediate the ends thereof and including means for indicating the angle of the principal axis of the side rail relative to the vertical; and a second indicator element including a label adapted to be affixed to the side rail of the ladder in close proximity to the foot, said label having at least two zones defined by lines radiating from the pivotal axis of the foot, and a pointer adapted to be affixed to the foot and extending perpendicular to the bottom surface thereof, said pointer cooperating with said label to indicate the angular relation of the foot to the side rail.

2. The safety indicator according to claim 1 wherein said means for indicating comprises a spirit level.

3. The safety indicator according to claim 2 wherein said first indicator element includes a label having cautionary wording thereon, said level being affixed to said label.

* * * * *